US005933996A

United States Patent [19]

Chang

[11] Patent Number: 5,933,996

[45] Date of Patent: Aug. 10, 1999

[54] PHOTOGRAPH FRAME ASSEMBLY WITH A SLIDABLE AND ROTATABLE SUPPORTING MEMBER

[75] Inventor: Tung-Ming Chang, Taichung Hsien, Taiwan

[73] Assignee: Fanthing Electrical Corp., Taichung Hsien, Turkey

[21] Appl. No.: 09/211,361

[22] Filed: Dec. 14, 1998

[51] Int. Cl.[6] ..... A47G 1/24

[52] U.S. Cl. ..... 40/748; 40/747; 248/456

[58] Field of Search ..... 40/748, 747, 761, 40/762; 248/456, 454

[56] References Cited

U.S. PATENT DOCUMENTS

| | | | |
|---|---|---|---|
| 4,216,936 | 8/1980 | DeSelms | 40/762 |
| 5,746,410 | 5/1998 | Hung | 248/456 |
| 5,836,565 | 11/1998 | Chang | 40/748 |

*Primary Examiner*—Cassandra H. Davis
*Attorney, Agent, or Firm*—Ladas & Parry

[57] ABSTRACT

A photograph frame assembly includes a photograph frame, a back plate secured to the photograph frame, and a supporting member which is retained on the back plate by a retainer. The back plate has three interconnected sides which are arranged as a U-shape, and a slide slot unit, which is formed therethrough and which has an enlarged portion. The retainer extends through the slide slot unit in the back plate to couple with the supporting member, thereby retaining the supporting member on the back plate. The supporting member supports the back plate in an inclined position, and can be folded on the back plate. The retainer is capable of moving along the slide slot unit in the back plate, and of rotating within the enlarged portion of the slide slot unit so that the retainer can be moved to any position in the slide slot unit, thereby aligning a selected one of the three interconnected sides of the back plate with a horizontal bottom side of the supporting member.

4 Claims, 11 Drawing Sheets

PHOTOGRAPH FRAME ASSEMBLY WITH A SLIDABLE AND ROTATABLE SUPPORTING MEMBER

BACKGROUND OF THE INVENTION

This invention relates to a photograph frame assembly with a supporting member for supporting a photograph frame in an inclined position, more particularly to a rectangular photograph frame assembly which has a slidable and rotatable supporting member that can be adjusted to contact a selected one of three sides of a photograph frame with a support, such as a desk top, when supporting the photograph frame.

2. Field of the Related Art

Referring to FIG. 1, a conventional photograph frame assembly is shown to include a rectangular photograph frame 10, a back plate 11, a hinge unit 12, and a supporting member 13. The supporting member 13 is mounted rotatably on a rear side surface of the back plate 11 by means of the hinge unit 12, and has a V-shaped lower end portion, which includes an inclined first side 131 and an inclined second side 132. The photograph frame 10 and the back plate 11 can be supported by the supporting member 23 in a first position shown in FIG. 1, where a short side 112 of the back plate 11 is aligned with the inclined first side 131 of the supporting member 13, or a second position shown in FIG. 2, where a long side 113 of the back plate 11 is aligned with the inclined second side 132 of the supporting member 13. When the aforesaid conventional photograph frame is supported on a desk, only two choices can be effected on the relative positions between the supporting member 3 and the back plate 11, thereby failing to satisfy the needs of the user.

SUMMARY OF THE INVENTION

The object of this invention is to provide a rectangular photograph frame assembly with a slidable and rotatable supporting member, which can be adjusted to contact a selected one of three sides of a photograph frame with a support, such as a desk top, when supporting the frame.

According to this invention, a photograph frame assembly includes a photograph frame, a back plate secured to the photograph frame, and a supporting member which is retained on the back plate by means of a retainer. The back plate has three interconnected sides which are arranged as a U-shape, and a slide slot unit, which is formed therethrough and which has an enlarged portion. The retainer extends through the slide slot unit in the back plate to couple with the supporting member, thereby retaining the supporting member on the back plate. The supporting member supports the back plate in an inclined position, and can be folded on the back plate. If desired, the retainer is capable of moving along the slide slot unit in the back plate, and of rotating within the enlarged portion of the slide slot unit to align a selected one of three interconnected sides of the back plate with a horizontal bottom side of the supporting member.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
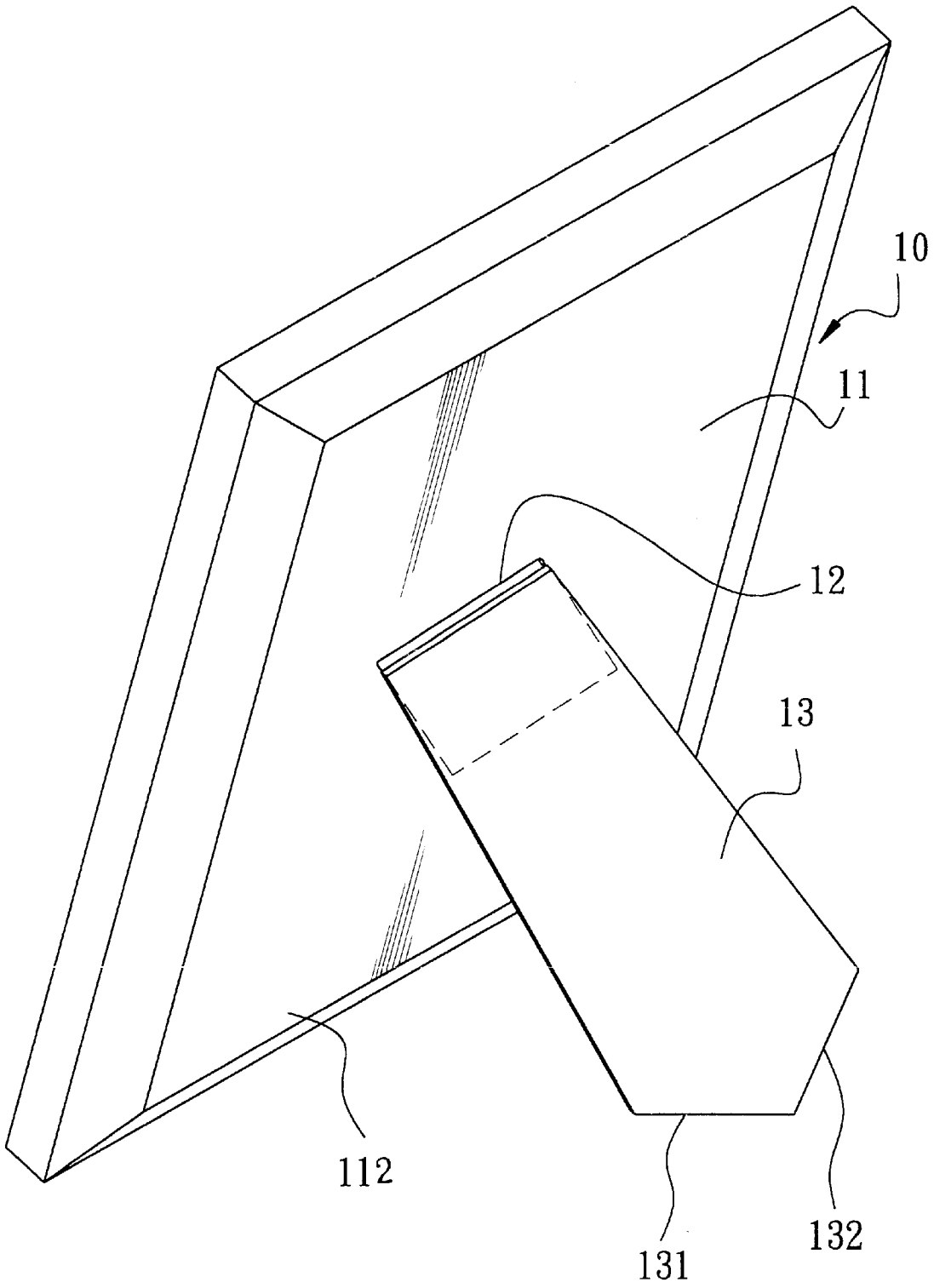
FIG. 1 PRIOR ART
FIGS. 1 and 2 illustrate two relative positions of a supporting member and a back plate of a conventional photograph frame assembly.
Figure 2:
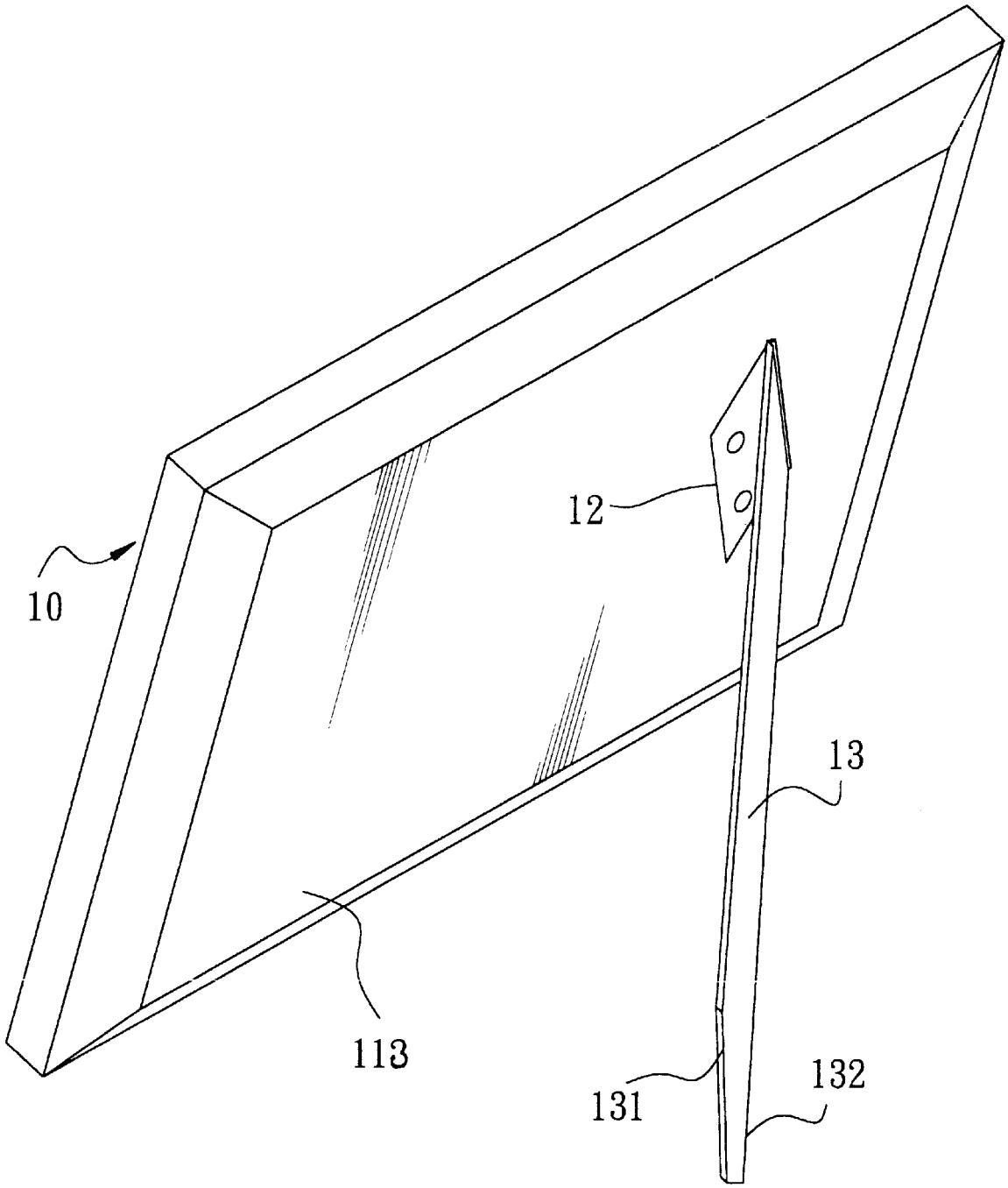
FIG. 2 PRIOR ART
Figure 3:
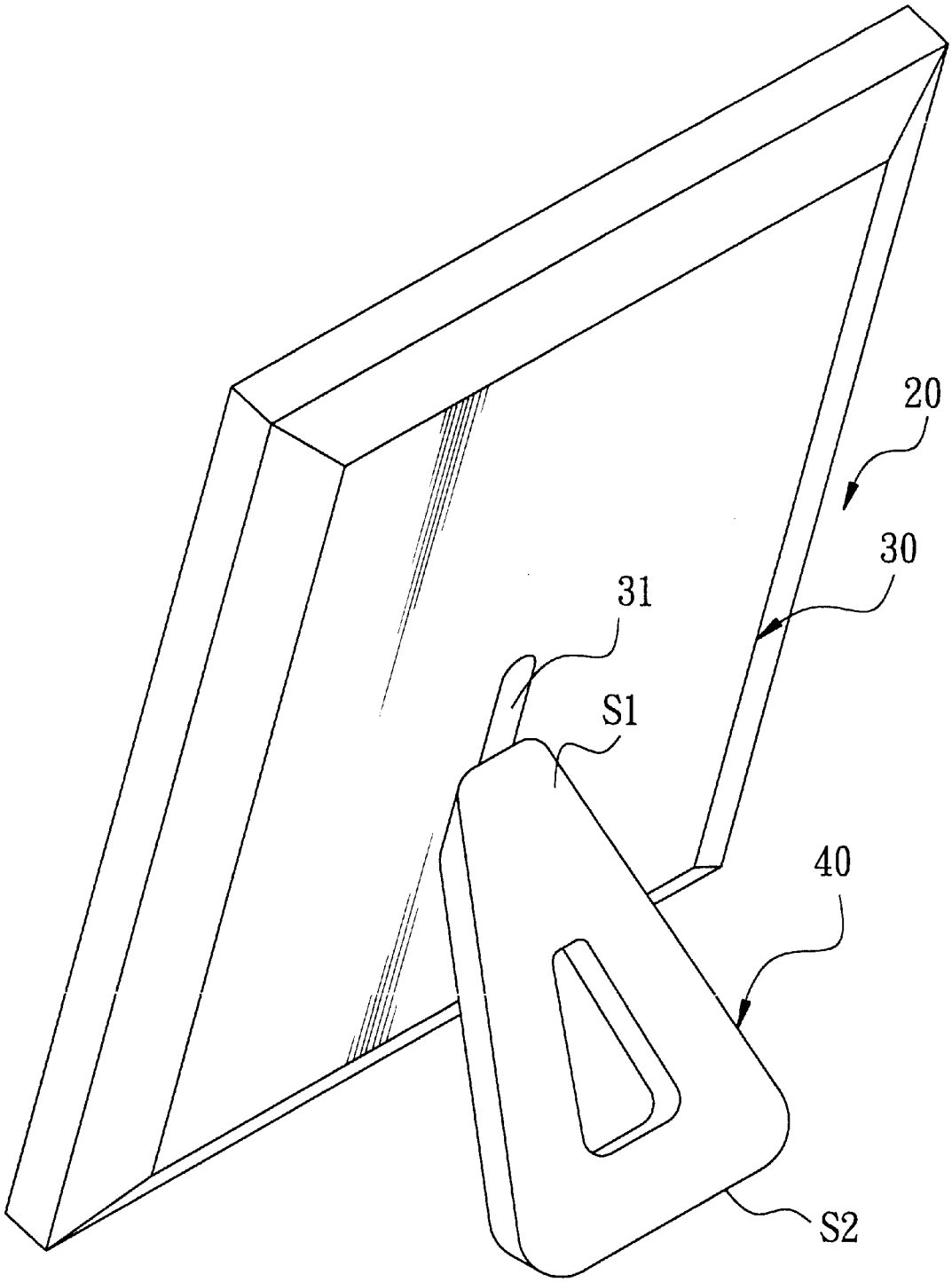
FIG. 3 is an assembled perspective view of the preferred embodiment of a photograph frame assembly according to this invention.
Figure 4:
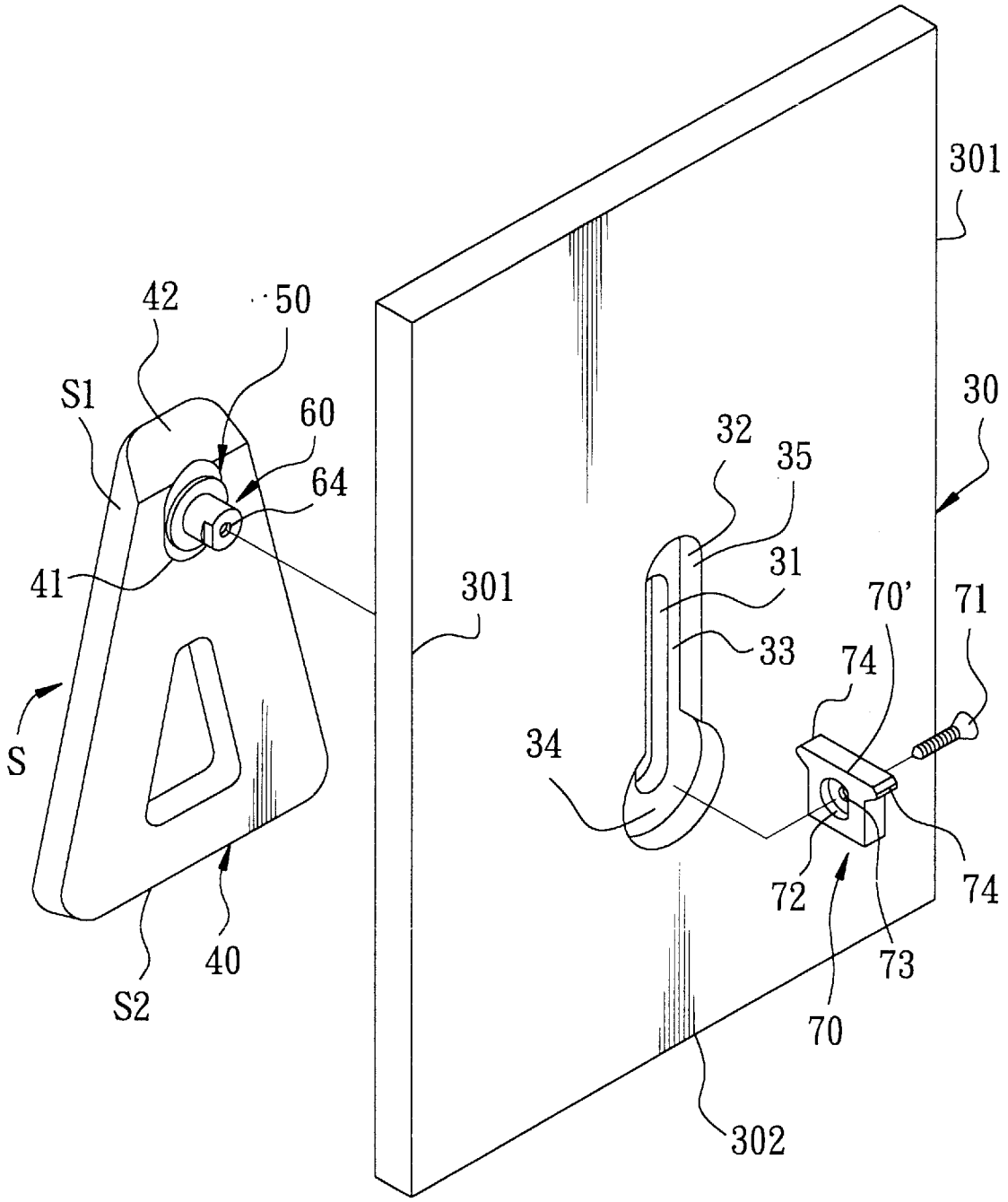
FIG. 4 is a partly exploded perspective view of the preferred embodiment.
Figure 5:
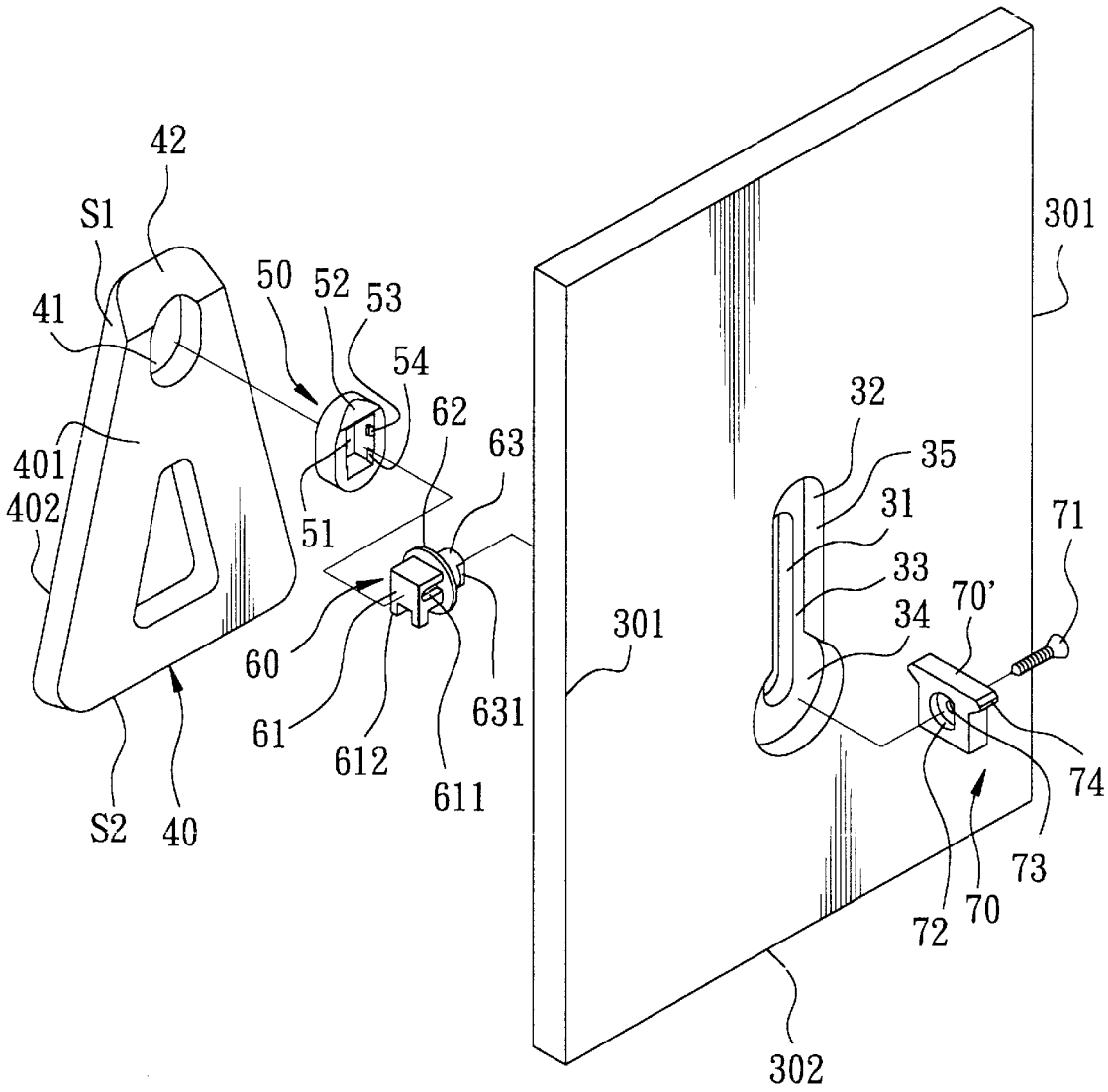
FIG. 5 is an exploded perspective view of the preferred embodiment.

Referring to FIGS. 3, 4 and 5, the preferred embodiment of a photograph frame assembly according to this invention is shown. The assembly includes a rectangular photograph frame 20, a rectangular back plate 30, and a supporting member (S), which consists of a triangular plate 40, an annular fixed element 50, and a movable element 60. The supporting member (S) is retained on the back plate 30 by means of a retainer 70. The fixed element 50 and the movable element 60 are unitary, and are made of plastic.

Figure 7:
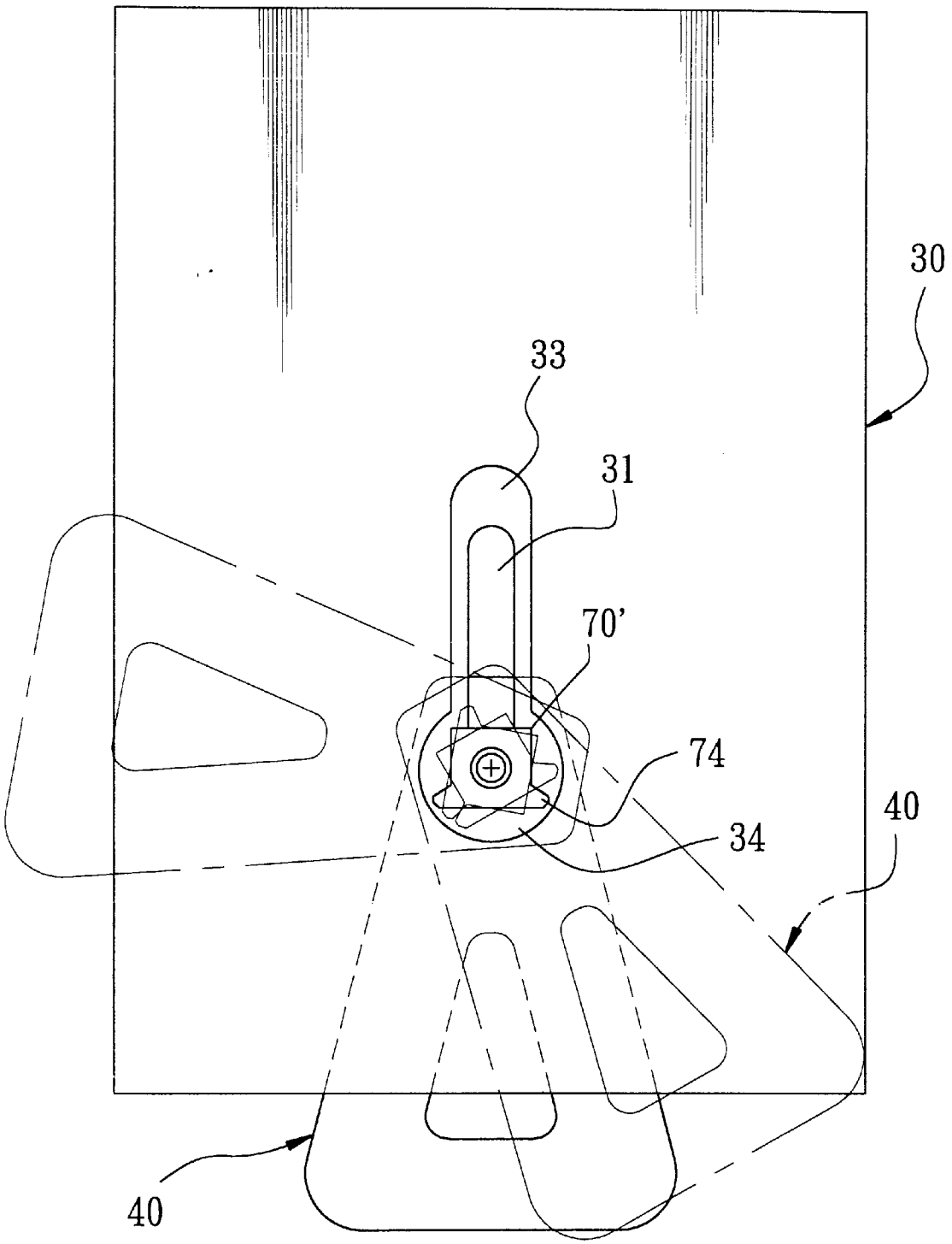
FIG. 7 is a schematic view illustrating how a retainer is rotated within an enlarged end portion of a large slide slot in a back plate of the preferred embodiment.

The back plate 30 has two parallel straight first sides 301, and a straight second side 302, which is connected perpendicularly to the first sides 301 at two ends thereof. The first and second sides 301, 302 are arranged as a U-shape. In this embodiment, the first sides 301 are longer than the second side 302. A slide slot unit is formed through the back plate 30, and includes a closed small slide slot 31 and a closed large slide slot 32 that extend in a direction parallel to the first sides 301 of the back plate 30. The large slide slot 32 is formed in a front side surface of the back plate 30, and has a uniform-width portion 33 and an enlarged end portion 34, which is sized to permit rotation of the retainer 70 therein, as shown in FIG. 7. The uniform-width portion 33 is defined by two parallel side walls 35. The small slide slot 31 is formed in a rear side surface of the back plate 30, and has a width and length that are smaller than those of the large slide slot 32. Furthermore, the small slide slot 31 is located in and communicated with the large slide slot 32, and extends into the enlarged end portion 34 of the large slide slot 32.

The supporting member (S) has a coupling upper end portion (S1) and a horizontal bottom side (S2), and supports the back plate 30 in an inclined position.

The retainer 70 extends through the slide slot unit in the back plate 30 to couple with the coupling upper end portion (S1) of the supporting member (S), and is capable of moving in the slide slot unit and rotating within the enlarged end portion 34 of the large slide slot 32 to align a selected one of the first and second sides 301, 302 of the back plate 30 with the horizontal bottom side (S2) of the supporting member (S).

Figure 8:
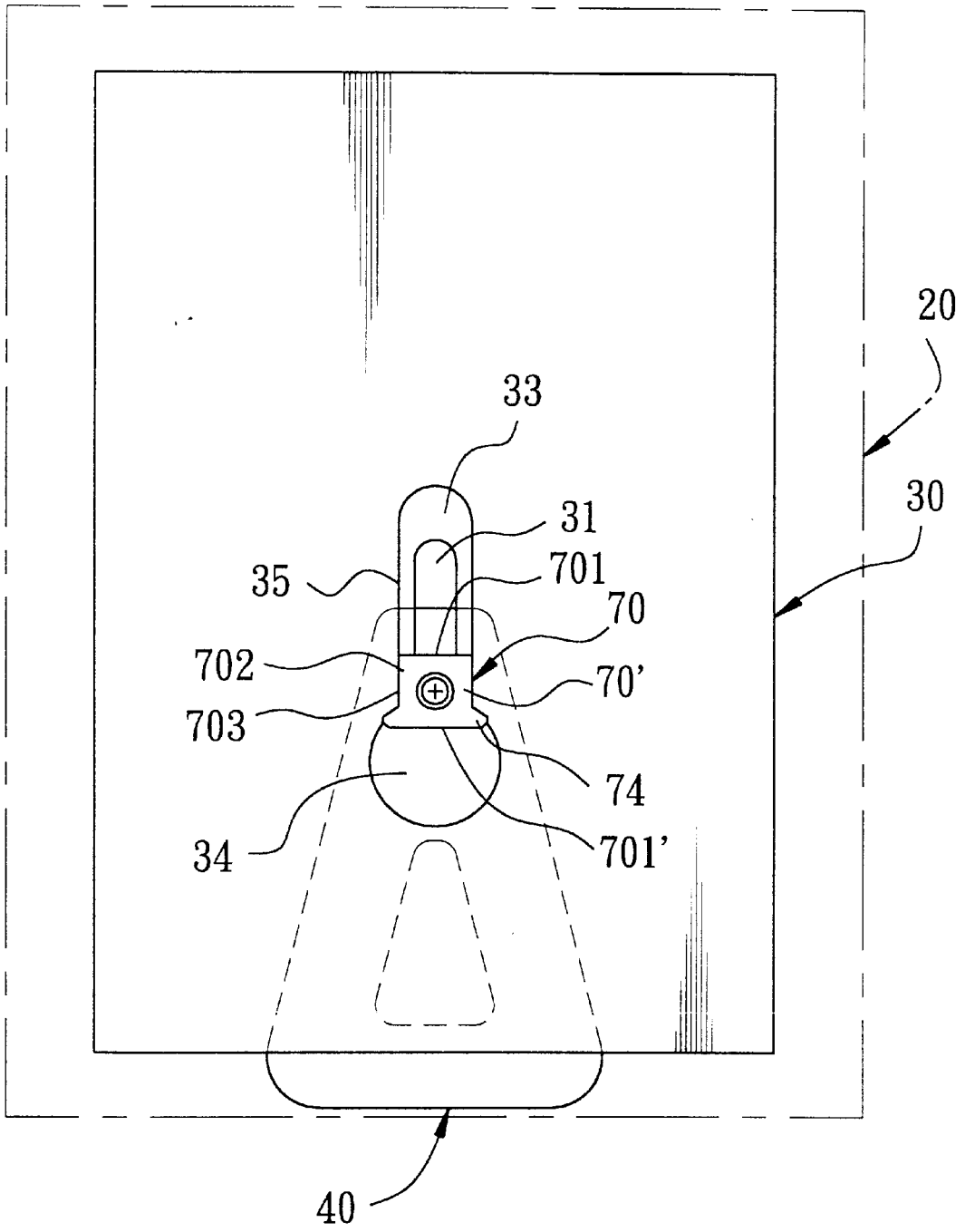
FIGS. 8, 9 and 10 illustrate three relative positions between a supporting member and the back plate of the preferred embodiment.
Figure 9:
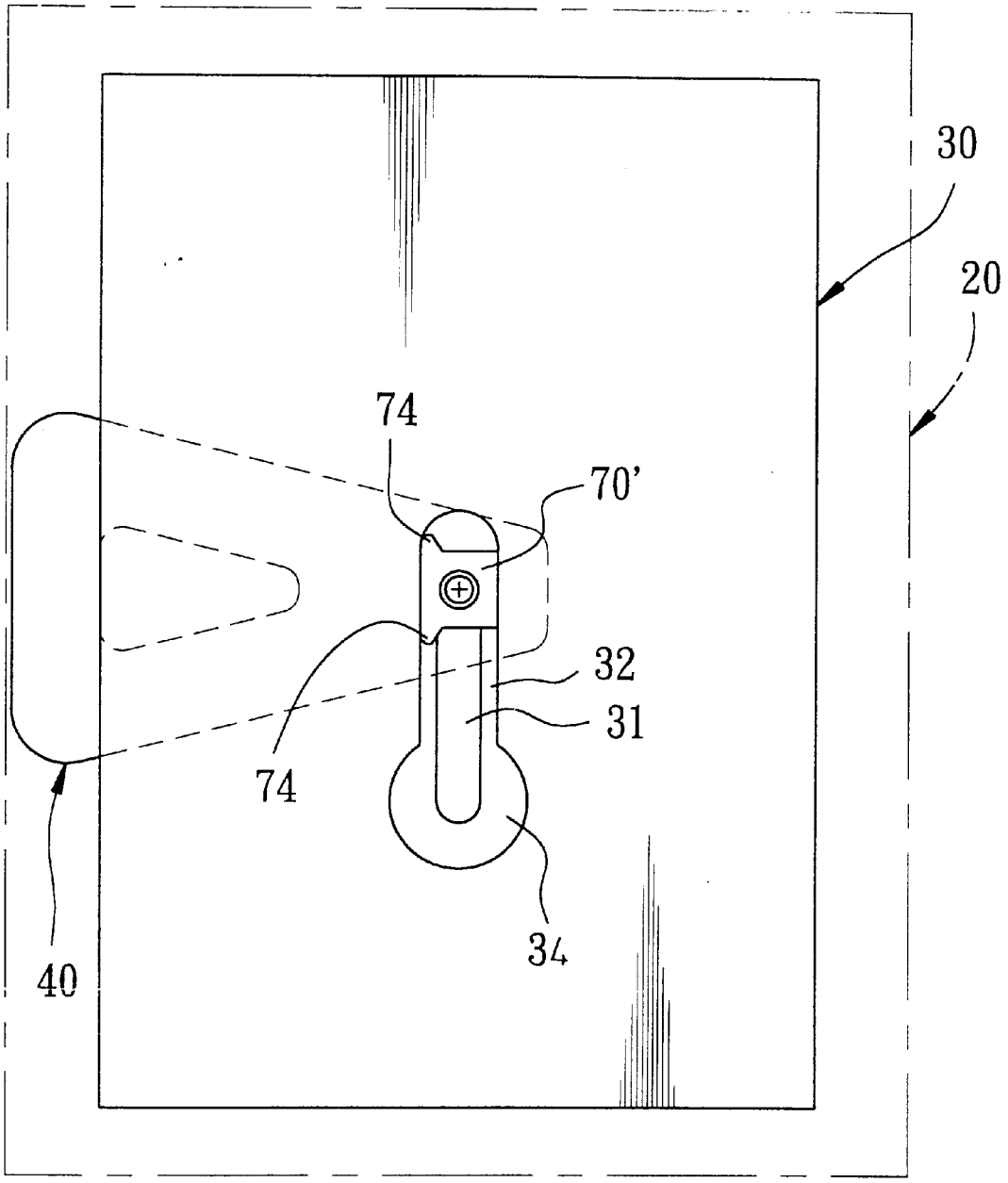

Referring to FIGS. 8 and 9, the retainer 70 includes a plate body 70' and a screw 71. The plate body 70' has two opposite long sides 701, 701', and a generally rectangular insert 702 with two opposite short sides 703. Two opposed blocking arms 74 extend respectively and integrally from two opposite sides of the insert 702, and are located respectively at two end portions of the long side 701'. The long side 701 has two ends, which are connected respectively and perpendicularly to the short sides 703. The distances between the long sides 701 and 701' and between the short sides 703 are slightly smaller than the width of the uniform-width portion 33 of the large slide slot 31 in the back plate 30.

Figure 10:
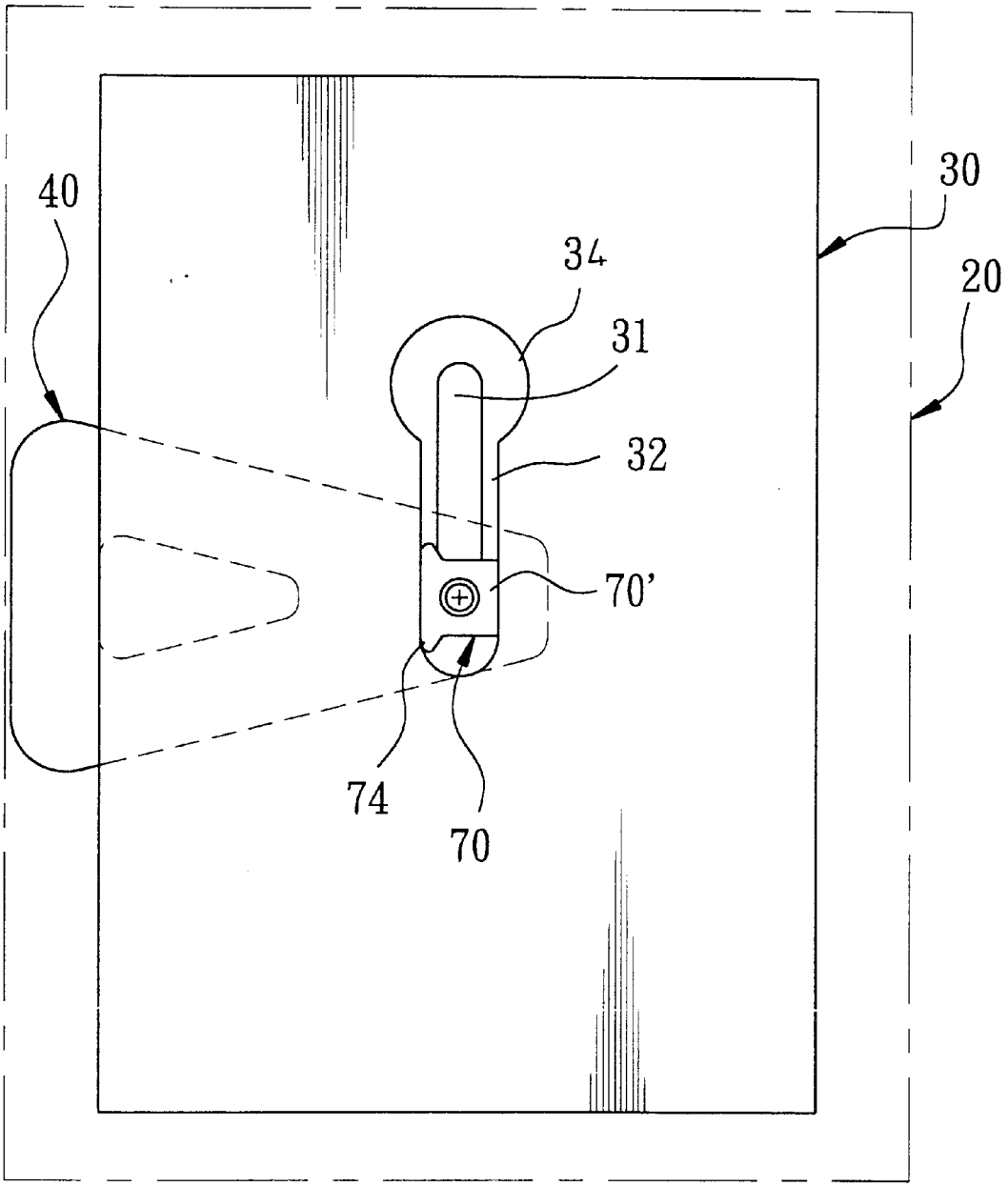

The retainer 70 is movable between a first position shown in FIG. 8 and a second position shown in FIG. 9 or 10. When the retainer 70 is located at the first position, the insert 702 is inserted into the uniform-width portion 33 of the large slide slot 31 in such a manner that the short sides 703 of the insert 702 abut respectively against the side walls 35 of the uniform-width portion 33 of the large slide slot 32. In this situation, the blocking arms 74 are located within the enlarged end portion 34 of the large slide slot 31 to prevent the retainer 70 from moving entirely into the uniform-width portion 33 of the large slide slot 31. As such, the horizontal bottom side (S2) of the supporting member (S) is aligned with the second side 302 of the back plate 30.

When the retainer 70 is located at the second position, the retainer 70 is engaged entirely within the uniform-width portion 33 of the large slide slot 31. In this situation, the long sides 701, 701' abut respectively against the side walls 35 of the uniform-width portion 33 of the large slide slot 31. As such, the horizontal bottom side (S2) of the supporting member (S) can be aligned with a selected one of the first sides 301 of the back plate 30 by adjusting the relative position between the long sides 701, 701' of the retainer 70.

Figure 6:
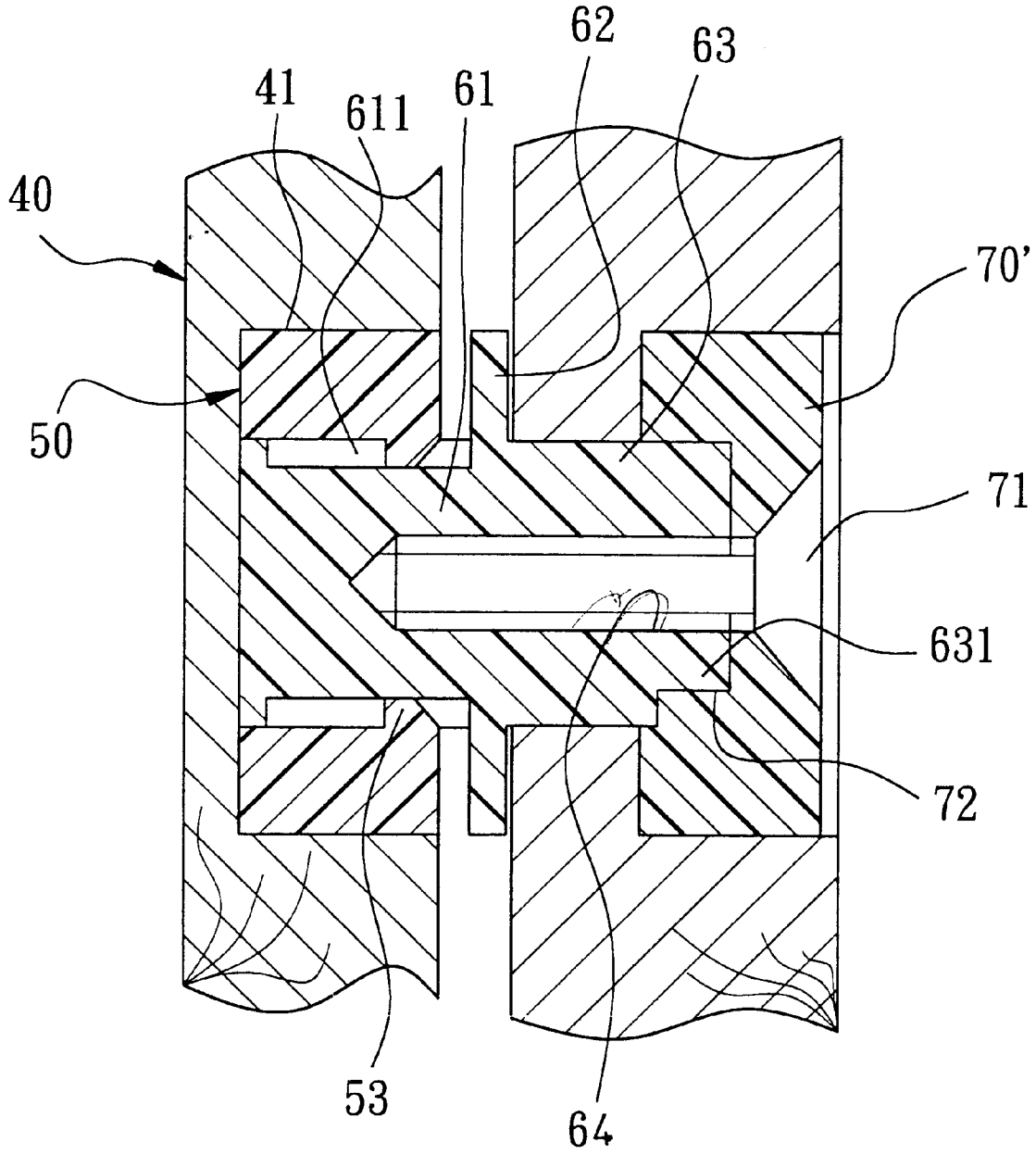
FIG. 6 is a fragmentary sectional view of the preferred embodiment.
Figure 11:
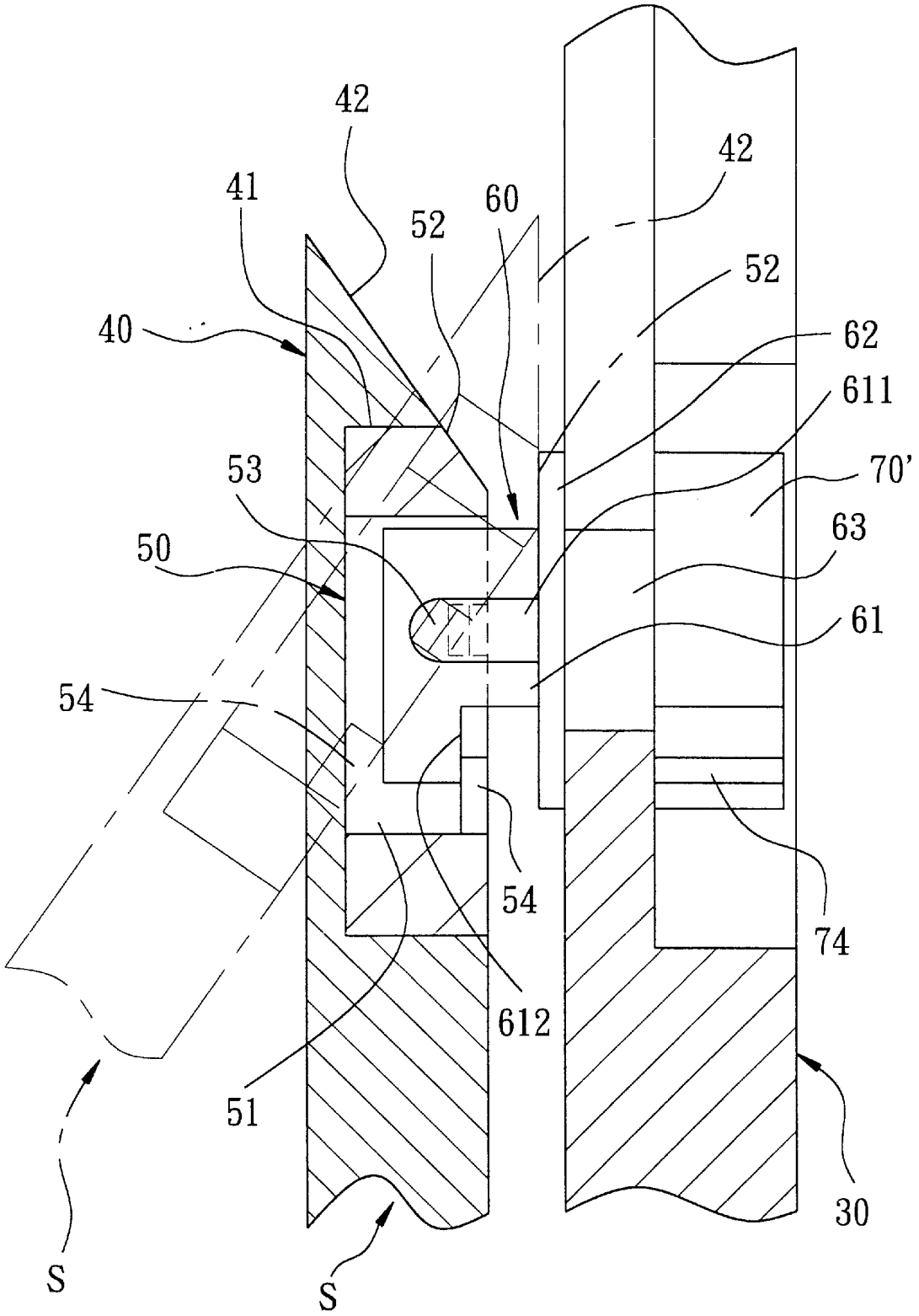
FIG. 11 illustrates how the supporting member is folded on the back plate.

Referring to FIGS. 5, 6 and 11, the plate body 70' has a rear side surface which is formed with a generally semicircular groove 72, and a front side surface, which is formed with a fastener hole 73 and which is communicated with the generally semicircular groove 72 in the rear side surface of the plate body 70'.

The triangular plate 40 has a flat front side surface 401, a flat rear side surface 402, an accommodating hole 41 formed through an upper end portion of the plate 40, and an inclined abutment surface 42. The abutment surface 42 is at an angle to the flat front and rear side surfaces 401, 402, and abuts against the rear side surface of the back plate 30.

The fixed element 50 is adhered into the accommodating hole 41 in the triangular plate 40, and has a central hole 51 formed therethrough, and an inclined abutment surface 52, which abuts against the rear side surface of the back plate 30 and which is flush with the inclined abutment surface 42 of the triangular plate 40. In the central hole 51, two opposed horizontal upper projections 53, and two opposed horizontal lower projections 54 are formed on the fixed element 50. The lower projections 54 are located under the upper projections 53, respectively.

The movable element 60 includes a rear section 61, a middle disk 62, and a front section 63.

The rear section 61 extends slidably into the central hole 51 in the fixed element 50, and has two vertical side surfaces each of which has a retaining slot 611. The retaining slots 611 receive respectively and slidably the upper projections 53 of the fixed element 50 therein to retain the movable element 60 on the fixed element 50. Two spaced-apart legs 612 protrude integrally and downwardly from two opposite sides of a rear end portion of the rear section 61.

The disk 62 is formed integrally with a front end portion of the rear section 61, and abuts against the rear side surface of the back plate 30 at a periphery of the disk 62.

The front section 63 is formed integrally with the disk 62 at a rear end portion thereof, and has a generally semicircular-cross-sectioned front end portion 631 and a front end surface which is formed with a threaded hole 64 (see FIG. 4).

The screw 71 extends rotatably through the fastener hole 73 and the generally semicircular hole 72 of the plate body 70' and the small and large slide slots 31, 32 in the back plate 30 to engage the threaded hole 64 in the front section 63 of the movable element 60, thereby retaining the movable element 60 on the back plate 30. Because the distance between the disk 62 and the plate body 70' is longer than the depth of the small slide slot 31, the retainer 70 can slide and rotate in the small and large slide slots 31, 32 in the back plate 30.

Referring to FIG. 11, the supporting member (S) can be turned from a supporting position shown in phantom lines, where the back plate 30 is supported in an inclined position, to a folded position shown in solid lines.

To position the supporting member (S) on the back plate 30, the lower projections 54 of the fixed element 50 are movable relative to the back plate 30 between a first position shown in phantom lines, where the lower projections 54 abut respectively against the rear faces of the legs 612 of the movable element 60 to locate the supporting member (S) at the supporting position, and a second position, where the lower projections 54 abut respectively against the front faces of the legs 612 of the movable element 60 to locate the supporting member (S) at the folded position. The lower projections 54 of the fixed elements 50 and the legs 612 of the movable elements constitute a positioning device, which locates the supporting member (S) at either of the supporting position and the folded position.

Since the fixed element 50 and the movable element 60 are made of plastic, the upper projections 53 of the fixed element 50 can be easily inserted into the retaining slots 611 in the movable element 60 to couple the fixed element 50 and the movable element 60 together, and the lower projections 54 of the fixed element 50 can be moved between the first position behind the legs 612 of the movable elements 60 and the second position in front of the legs 612 of the movable elements 60.

With this invention thus explained, it is apparent that numerous modifications and variations can be made without departing from the spirit and scope of this invention. It is therefore intended that this invention be limited only as indicated in the appended claims.

I claim:

1. A photograph frame assembly comprising:

a photograph frame;

a back plate having two parallel straight first sides, a straight second side connected perpendicularly to said first sides at two ends thereof in such a manner that said first and second sides are arranged as a U-shape, a front side surface which is secured to said photograph frame, a rear side surface, and a slide slot unit, which is formed though said back plate and which extends in a direction parallel to one of said first and second sides of said back plate, said slide slot unit having an enlarged portion;

a supporting member having a coupling upper end portion and a horizontal bottom side and located at a supporting position to support said back plate in an inclined position, said supporting member being movable to a folded position in which said supporting member is folded on said back plate;

a retainer extending through said slide slot unit in said back plate to couple with said coupling upper end portion of said supporting member to retain said supporting member on said back plate, said retainer being movable within said slide slot unit in said back plate and rotating within said enlarged portion of said slide slot unit so that said retainer can be moved to any position in said slide slot unit, thereby aligning a selected one of said first and second sides of said back plate with said horizontal bottom side of said supporting member; and a positioning device for positioning said supporting member relative to said back plate.

2. A photograph frame assembly as claimed in claim 1, wherein said slide slot unit includes a closed large slide slot, which is formed in said front side surface of said back plate and which extends in a direction parallel to said first sides of said back plate, said large slide slot having a uniform-width portion and an enlarged end portion, which is sized to permit rotation of said retainer therein and which constitutes said enlarged portion of said slide slot unit, said uniform-width portion of said large slide slot being defined by two parallel side walls, said retainer having two opposite long sides, a generally rectangular insert with two opposite short sides, and two opposed blocking arms which extend respectively and integrally from two opposite sides of said insert, the distances between said long sides of said retainer and between said short sides of said insert being slightly smaller than the width of said uniform-width portion of said large slide slot, said retainer being movable between a first position, where said insert is inserted into said uniform-width portion of said large slide slot in such a manner that said short sides of said insert abut respectively against said side walls of said uniform-width portion of said large slide slot and that said blocking arms are located within said enlarged end portion of said large slide slot to prevent said retainer from moving entirely into said uniform-width portion of said large slide slot, and a second position, where said retainer is engaged entirely within said uniform-width portion of said large slide slot in such a manner that said long sides of said retainer abut respectively against said side walls of said uniform-width of said large slide slot, said horizontal bottom side of said supporting member being aligned with said second side of said back plate upon location of said retainer at said first position and with a selected one of said first sides of said back plate upon location of said retainer at said second position.

3. A photograph frame assembly as claimed in claim 2, wherein said slide slot unit further has a closed small slide slot which is formed in said rear side surface of said back plate and which has a width and a length that are smaller than those of said large slide slot, said small slide slot being located in and communicated with said large slide slot and extending into said enlarged end portion of said large slide slot, said coupling upper end portion of said supporting member having a threaded hole formed therein, said retainer including a screw, which extends through said small and large slide slots in said back plate to engage said threaded hole in said supporting member.

4. A photograph frame assembly as claimed in claim 3, wherein said retainer includes a plate body, said plate body having a front side surface which is formed with a fastener hole, and a rear side surface which is formed with a generally semicircular groove and which is communicated with said fastener hole in said front side surface of said plate body, said supporting member including:

a triangular plate, which has a flat front side surface, a flat rear side surface parallel to said flat front side surface, an inclined abutment surface which is at an angle to said flat front and rear side surfaces and which abuts against said rear side surface of said back plate, and an accommodating hole formed in an upper end portion of said triangular plate;

a unitary annular plastic fixed element secured within said accommodating hole in said triangular plate and having a central hole formed through said fixed element, two opposed horizontal upper projection formed in said central hole, and two opposed horizontal lower projections formed in said central hole under said upper projections; and a unitary plastic movable element including a rear section extending slidably into said central hole in said fixed element and having two vertical side surfaces, two retaining slots which are formed respectively in said side surfaces of said rear section to receive respectively and slidably said upper projections of said fixed element therein, two spaced-apart legs protruding integrally and downwardly from two opposite sides of a rear end portion of said rear section, each of said legs having a front face and a rear face which is opposite to said front face, a middle disk formed integrally with a front end portion of said rear section and abutting against said rear side surface of said back plate at a periphery of said disk; and a front section formed integrally with said disk at a rear end portion thereof and having a generally semicircular-cross-sectioned front end portion which engages fittingly said semicircular groove in said retainer, and a front end surface in which said threaded hole is formed, said screw extending through said fastener hole and said generally semicircular hole in said plate body and said large and small slide slots in said back plate to engage said threaded hole in said front section, thereby retaining said movable element on said back plate;

said lower projections of said fixed element being movable relative to said back plate between a first position, where said lower projections of said fixed elements abut respectively against said rear faces of said legs of said movable element to locate said supporting member at said supporting position, and a second position, where said lower projections of said fixed elements abut respectively against said front faces of said legs of said movable element to locate said supporting member at said folded position, said lower projections of said fixed elements and said legs of said movable elements constituting said positioning device.

* * * * *